United States Patent [19]

McDuffie

[11] 4,237,097

[45] Dec. 2, 1980

[54] INCENSE BURNER

[76] Inventor: Raleigh McDuffie, 11240 Kennebec, Detroit, Mich. 48205

[21] Appl. No.: 39,232

[22] Filed: May 14, 1979

[51] Int. Cl.[3] ..... A62B 7/08; F23D 3/16

[52] U.S. Cl. ..... 422/126; 431/289; 206/459; 229/22

[58] Field of Search ..... 431/289, 299; 126/59.5; 422/126

[56] References Cited

U.S. PATENT DOCUMENTS

| | | | |
|---|---|---|---|
| 1,782,919 | 11/1930 | Feldman | 229/22 |
| 2,530,529 | 11/1950 | Letang | 206/19 |
| 3,058,178 | 10/1962 | Canpagna | 422/126 |
| 3,666,607 | 5/1972 | Weissman | 229/22 |

*Primary Examiner*—George E. Lowrance

*Attorney, Agent, or Firm*—Cullen, Sloman, Cantor, Grauer, Scott & Rutherford

[57] ABSTRACT

An incense burner comprises a hollow housing of pyramid shape having pairs of opposed triangular side walls adapted for mounting upon a support surface. A vent aperture is provided within at least one of the side walls adjacent the apex. One side wall has a triangular opening therein. A pair of opposed guide rails are mounted upon the respective opposed side walls adjacent the triangular opening. A triangular door having a handle overlies the opening in one side wall and has a drawer secured thereto slidably mounted upon said rails. A candle holder and an incense holder are mounted upon said drawer for supporting a candle and a stick of combustible incense respectively whereby, the flame of the candle ultimately ignites the incense, with products of combustion escaping through the vent aperture.

8 Claims, 4 Drawing Figures

INCENSE BURNER

BACKGROUND OF THE INVENTION

Incense burners and related devices are known, as exemplified by the following U.S. Pat. Nos.:

666,873
721,133
1,115,067 (Lanturn)
1,162,682 (Smudging apparatus)
1,824,055
2,530,529
2,621,379
3,058,178
1,053,873 (Deodorizer).

While incense burners have been used of various constructions and over long periods of time, there have been no incense burners of pyramidal shape and wherein, convenient access to an incense holder is provided in the form of a drawer which is normally disposed within the burner housing and which can be retracted therefrom for loading and for ignition.

SUMMARY OF THE INVENTION

It is an object of the present invention to provide an improved incense burner which is of pyramidal shape and which is adapted for mounting upon a support surface and includes within one wall thereof a triangular opening and a door normally covering said opening and having a drawer attached thereto and slidably mounted within said housing adapted to support closely adjacent candle holder and incense holder.

It is another object to provide an occult pyramid-type incense burner construction and wherein, coloring is applied to the side walls thereof; brown for North representing Earth, blue for East representing Air, red for South representing Fire and green for West representing Water, said pyramid in use having its corresponding walls facing North, East, South and West respectively.

It is a further object to incorporate within the removable door construction a removable platform within said drawer for mounting holders for a candle and for incense and for providing a storage chamber within said drawer to receive a paper having a "good luck" wish thereon, a lottery ticket or other object and wherein, use of the incense burner of the present form is adapted to bring only good luck to the user, and the fulfillment of wishes.

These and other objects will be seen from the following specification and claims in conjunction with the accompanying drawing.

THE DRAWING

It will be understood that the above drawing illustrates merely a preferred embodiment of the invention, and that other embodiments are contemplated within the scope of the claims hereafter set forth.

DETAILED DESCRIPTION OF THE INVENTION

Figure 1:
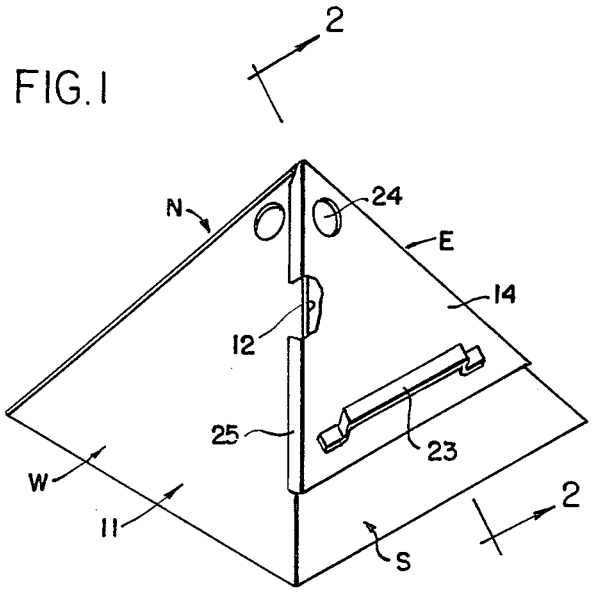
FIG. 1 is a partly cut away front perspective view of the present incense burner of pyramid form.

The present invention is directed to incense burners and particularly, to an incense burner having a hollow housing of pyramid shape as generally indicated at 11, FIG. 1, adapted for mounting upon any support surface. The pyramid housing includes a plurality of opposed pairs of upwardly inclined triangular side walls designated: N, E, S, W, corresponding to the polar directions North, East, South and West.

Figure 4:
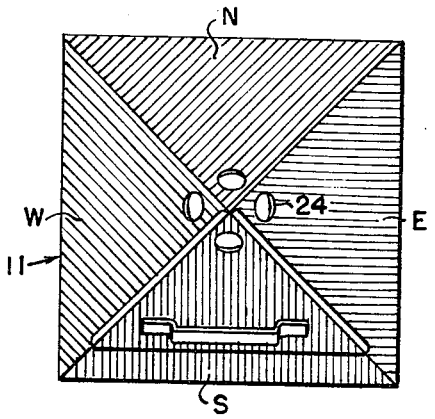
FIG. 4 is a plan view of the incense burner shown in FIG. 1.

As shown in FIG. 4, the respective walls N, E, S, and W are lined with the colors brown, blue, red and green, representing respectively: Earth, Air, Fire and Water. It is contemplated in use with the present pyramid incense burner that the respective side walls N, E, S and W face the corresponding polar directions.

Figure 2:
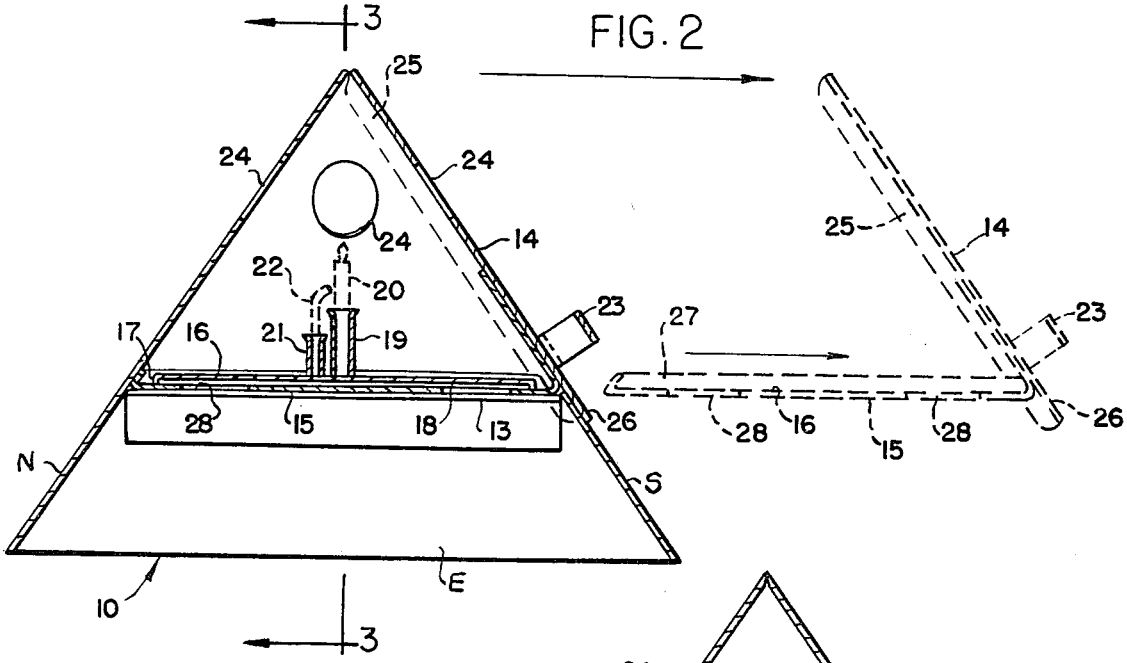
FIG. 2 is a vertical section thereof on an increased scale, taken in the direction of arrows 2—2 of FIG. 1, the removable drawer in FIG. 2 being shown in exploded retracted position in dash lines.
Figure 3:
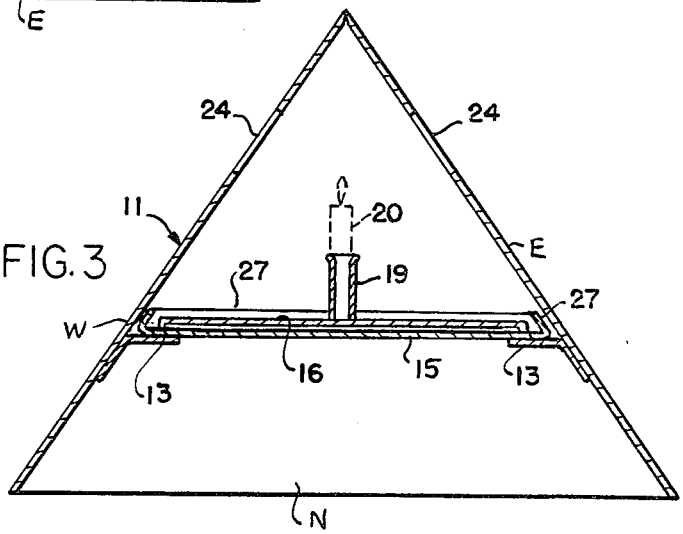
FIG. 3 is a vertical section taken in the direction of arrows 3—3 of FIG. 2.

The housing has an open bottom as at 10, FIG. 2. One side wall S is cut away from the apex of said side walls providing a triangular opening 12.

A pair of opposed rails 13 of angle shape are mounted upon the respective opposite side walls E and W adjacent the bottom of opening 12. A triangular door 14 having a handle 23 overlies the apertured side wall S and extends at a corresponding inclination as a continuation of side wall S and normally closes the triangular opening 12.

A horizontally disposed drawer 15, preferably of rectangular shape, along one edge is secured to said door, extends at an acute angle thereto, and is slidably supported upon said rails. The drawer includes the continuous upturned flange 27 around the edges thereof defining chamber 18 within said drawer.

Rectangular platform 16 having a downturned continuous flange 17 is removably positioned within said drawer within the chamber 18 therein, and provides a support for candle holder 19 for mounting candle 20 and for the closely adjacent incense holder 21 mounting the incense stick 22. The respective holders 19 and 21 are secured to platform 16 and project thereabove, extending towards the vent apertures 24.

Four such apertures are shown within the respective side walls and door 14. It is understood that the incense burner could utilize a single vent aperture for the purpose of exhausting products of combustion from said candle and ignitable incense.

Platform flange 17 elevates said platform above the bottom of drawer 15 to provide a suitable storage space within the chamber 18 and within which may be positioned some object designed to bring good luck to the user, as for example a sheet of paper with a good luck wish or other designation thereon, a lottery ticket or other reasonably flat object. It is contemplated by some of those using the present incense burner that with belief in the occult or in the signs of the zodiac that the burning of the candle and the incense within the pyramid incense burner and with the respective polar walls properly oriented in the corresponding polar directions will bring good luck to the user or the possible fulfillment of a wish designated upon the object stored within the drawer 15 during the burning of the candle and the incense.

It is contemplated with the construction shown in FIG. 4 that in addition to the respective colorings brown, blue, red and green, that it would be considered equivalent to have applied additionally to said surfaces or instead of the colors thereof, various zodiac symbols or colors corresponding to the zodiac calendar.

Of course, there are many who do not believe in the prediction of future happenings, the advice of crystal gazers and other sources. However, it has been found by the inventor that the use of the present pyramid incense burner in the manner above set forth has brought good luck on many occasions.

The present incense burner pyramid construction is relatively small in size. In the illustrative embodiment, the base dimensions are approximately eight or nine inches, however these dimensions could be varied as desired.

As a part of the triangular door construction 14, there are a pair of flanges 25 which extend from the opposite converging side edges thereof and are adapted to overly and cooperatively register with the adjacent opposed side walls E and W. The lower portion of the door 14 includes a flange 26 which extends below the guide rails 13 and is adapted to cooperatively overly an adjacent portion of the side wall S as a substantially smooth continuation thereof.

In use, the triangular door will assume the position shown in FIG. 1. It may be totally withdrawn as shown in FIG. 2 in dash lines or may be set at any intermediate position for the purpose of filling the candle and incense holder and for igniting the candle.

A plurality of vent apertures 28 are formed through the bottom of drawer 15 to facilitate the flow of combustion air through the housing and outwardly of the vent apertures 24.

The present incense burner pyramid may be used in a darkened room with the drawer and lighted candle partly opened. The pyramid may thus be used in meditations and seances. Projections of the candle light flame onto the room wall produce a hypnotic or kaleidoscopic effect.

Having described my invention, reference should now be had to the following claims.

I claim:

1. An incense burner comprising a hollow housing of pyramid shape having pairs of opposed triangular side walls converging to an apex, adapted for mounting upon a support surface;

a vent aperture within at least one side wall adjacent said apex;

one side wall being cut away from said apex downwardly defining a triangular opening in said side wall;

a pair of opposed guide rails mounted on the interior of the opposed side walls adjacent said triangular opening;

a triangular door having a handle overlying said one side wall at a corresponding inclination as a continuation thereof and normally overlapping and closing said triangular opening;

a horizontally disposed drawer of rectangular shape along one edge secured to said door at an acute angle thereto and slidably supported upon said rails;

a candle holder mounted upon said drawer adapted to support a candle;

and an incense holder mounted upon said drawer closely adjacent said candle adapted to support a stick of combustible incense closely adjacent said candle; whereby, as the candle gradually burns down, its flame is adapted to ignite said stick of incense, with the products of combustion escaping through said vent aperture.

2. In the incense burner of claim 1, said housing having an open bottom.

3. In the incense burner of claim 1, elongated converging flanges on said door extending along the sides thereof and cooperatively engaging the corresponding adjacent side walls.

4. In the incense burner of claim 3, said door extending below said rails and overlying a portion of said cut away side wall.

5. In the incense burner of claim 1, said drawer having an upturned continuous flange along its other edges defining a chamber;

the mounting of said candle holder and incense holder including a platform removably nested within said drawer;

said holders being secured to said platform;

said chamber having a storage space adapted to receive a paper having a written good luck wish or the like thereon, a lottery ticket or other object disposed below said platform.

6. In the incense burner of claim 5, there being a peripheral depending flange on said platform defining said storage space.

7. In the incense burner of claim 1, there being vent apertures in the other side walls adjacent said apex.

8. In the incense burner of claim 1, each of said side walls including said door being colored brown for North representing "Earth", blue for East representing "Air", red for South representing "Fire", and green for West representing "Water", said pyramid adapted for use upon said support surface with the aforementioned corresponding walls respectively facing North, East, South, and West.

* * * * *